US010801232B2

(12) United States Patent
Carter

(10) Patent No.: US 10,801,232 B2
(45) Date of Patent: Oct. 13, 2020

(54) HANGING ROOM FOR A TEMPORARY SHELTER

(71) Applicant: Mark C. Carter, Norco, CA (US)

(72) Inventor: Mark C. Carter, Norco, CA (US)

(73) Assignee: INTERNATIONAL E-Z UP, INC., Norco, CA (US)

( * ) Notice: Subject to any disclaimer, the term of this patent is extended or adjusted under 35 U.S.C. 154(b) by 0 days.

(21) Appl. No.: 16/397,994

(22) Filed: Apr. 29, 2019

(65) Prior Publication Data

US 2019/0330875 A1 Oct. 31, 2019

Related U.S. Application Data

(60) Provisional application No. 62/664,843, filed on Apr. 30, 2018.

(51) Int. Cl.

| | |
|---|---|
| ***E04H 15/54*** | (2006.01) |
| ***E04H 15/64*** | (2006.01) |
| ***E04H 15/42*** | (2006.01) |
| *E04H 15/50* | (2006.01) |

(52) U.S. Cl.

CPC ..... *E04H 15/64* (2013.01); *E04H 15/42* (2013.01); *E04H 15/54* (2013.01); *E04H 15/50* (2013.01)

(58) Field of Classification Search

CPC ..... E04H 15/42; E04H 15/54; E04H 15/18
See application file for complete search history.

(56) References Cited

U.S. PATENT DOCUMENTS

| | | | | |
|---|---|---|---|---|
| 893,406 | A | 7/1908 | Wenzel | |
| 1,856,658 | A | 5/1932 | Rummler | |
| 4,354,091 | A | 10/1982 | Bain | |
| 5,421,355 | A * | 6/1995 | Cantwell | E04H 15/425 135/115 |
| 5,732,726 | A * | 3/1998 | Lee | E04H 15/42 135/114 |
| 6,021,795 | A * | 2/2000 | Long | E04H 15/42 135/118 |
| 6,681,786 | B2 * | 1/2004 | Ju | E04H 15/48 135/118 |
| 6,701,948 | B2 | 3/2004 | Jopp et al. | |
| 6,776,179 | B1 * | 8/2004 | Chen | E04H 15/42 135/135 |
| 8,001,987 | B2 | 8/2011 | Williams | |

(Continued)

FOREIGN PATENT DOCUMENTS

WO WO-2015031618 A1 * 3/2015

OTHER PUBLICATIONS

Standing room 100 hanging tent, Standing Room Tent Supply, http://www.standingroomtents.com/.

(Continued)

*Primary Examiner* — David R Dunn
*Assistant Examiner* — Danielle Jackson
(74) *Attorney, Agent, or Firm* — Seyfarth Shaw LLP; Puya Partow-Navid

(57) ABSTRACT

A hanging room is presented. The hanging room includes three or more sides. The hanging room also includes multiple fastening straps. Each first fastening strap is attached to one side of the three or more sides. The hanging room further includes multiple fasteners, each fastener is attached to one fastening strap. Each fastener attaches the hanging room to a shelter.

8 Claims, 12 Drawing Sheets

(56) References Cited

U.S. PATENT DOCUMENTS

| | | | | |
|---|---|---|---|---|
| 8,763,621 | B2 * | 7/2014 | Jin | E04H 15/44 135/115 |
| 8,869,814 | B2 * | 10/2014 | Jin | E04H 15/34 135/115 |
| 9,140,030 | B2 * | 9/2015 | Jin | E04H 15/46 |
| 10,010,477 | B2 * | 7/2018 | Durfee | A61H 33/066 |
| 10,167,644 | B1 | 1/2019 | Aliev | |
| 10,233,665 | B1 * | 3/2019 | Lee | E04H 15/32 |
| 2003/0037812 | A1 * | 2/2003 | Stewart | A47K 3/286 135/96 |
| 2009/0065037 | A1 | 3/2009 | Hauschild et al. | |
| 2010/0212085 | A1 | 8/2010 | Stewart et al. | |
| 2013/0276382 | A1 * | 10/2013 | Workman | E04H 15/44 52/63 |
| 2018/0142494 | A1 * | 5/2018 | Lah | E04H 15/64 |
| 2019/0078349 | A1 | 3/2019 | Carter | |

OTHER PUBLICATIONS

Ozark trail 2-room instant shower/utility shelter, Walmart, https://www.walmart.com/ip/Ozark-Trail-2-Room-Instant-Shower-Utility-Shelter/42391766#about-item.

'E-Z UP Hang Space' (E-Z UP Shelters), Jul. 25, 2017, retrieved from: https://www.youtube.com/watch?v=-oqk_wdv3Pc.

'New Hang Space by E-Z UP the solution for instant storage or changing-room space' (E-Z UP), retrieved from: https://www.ezup.com/media-room/product-news/hang-space.

International Search Report dated Jul. 9, 2019, received for PCT/US2019/030062.

* cited by examiner

HANGING ROOM FOR A TEMPORARY SHELTER

CROSS REFERENCE TO RELATED APPLICATION

This application claims the benefit of U.S. Provisional Application No. 62/664,843, entitled "HANGING ROOM FOR A TEMPORARY SHELTER," filed on Apr. 30, 2018, the disclosure of which is expressly incorporated by reference herein in its entirety.

BACKGROUND

Field

Certain aspects of the present disclosure generally relate to folding, collapsible structures and, more particularly, to a collapsible, shelter structure with a collapsible hang space.

Background

Temporary shelters that can be easily transported and rapidly set up at emergency sites can be particularly useful in providing temporary care and housing. Such shelters can also be useful for non-emergency outdoor gatherings, such as for temporary military posts, field trips, and the like. The temporary shelters may have a frame of X-shaped links, telescoping legs, and a canopy covering the frame. The legs of the shelter are capable of telescoping to approximately twice their stowed length, and the frame of X-shaped truss pairs is capable of horizontal extension between the legs to support a canopy. The frame can be constructed of lightweight material, and the telescoping legs can be extended to raise the frame of the shelter.

As the use of temporary shelters increase, there is a need to provide a secluded area within the shelter. For example, some temporary shelters are used to sell goods, such as clothing. In such cases, it is desirable to provide a secluded area for storing goods and/or for changing clothes. Conventional shelters do not include secluded areas. It is desirable to provide a portable room that may be attached to a temporary shelter to provide a secluded area within the temporary shelter.

SUMMARY

In one aspect, a hanging room is disclosed. The hanging room includes three or more sides. The hanging room also includes multiple fastening straps. Each first fastening strap is attached to one side of the three or more sides. The hanging room further includes multiple fasteners, and each fastener is attached to one fastening strap. Each fastener attaches the hanging room to a shelter.

Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The features, nature, and advantages of the present disclosure will become more apparent from the detailed description set forth below when taken in conjunction with the drawings in which like reference characters identify correspondingly throughout.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Based on the teachings, one skilled in the art should appreciate that the scope of the disclosure is intended to cover any aspect of the disclosure, whether implemented independently of or combined with any other aspect of the disclosure. For example, an apparatus may be implemented or a method may be practiced using any number of the aspects set forth. In addition, the scope of the disclosure is intended to cover such an apparatus or method practiced using other structure, functionality, or structure and functionality in addition to or other than the various aspects of the disclosure set forth. It should be understood that any aspect of the disclosure disclosed may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the disclosure. Although some benefits and advantages of the preferred aspects are mentioned, the scope of the disclosure is not intended to be limited to particular benefits, uses or objectives. Rather, aspects of the disclosure are intended to be broadly applicable to different technologies, system configurations, networks and protocols, some of which are illustrated by way of example in the figures and in the following description of the preferred aspects. The detailed description and drawings are merely illustrative of the disclosure rather than limiting, the scope of the disclosure being defined by the appended claims and equivalents thereof.

Figure 1A:
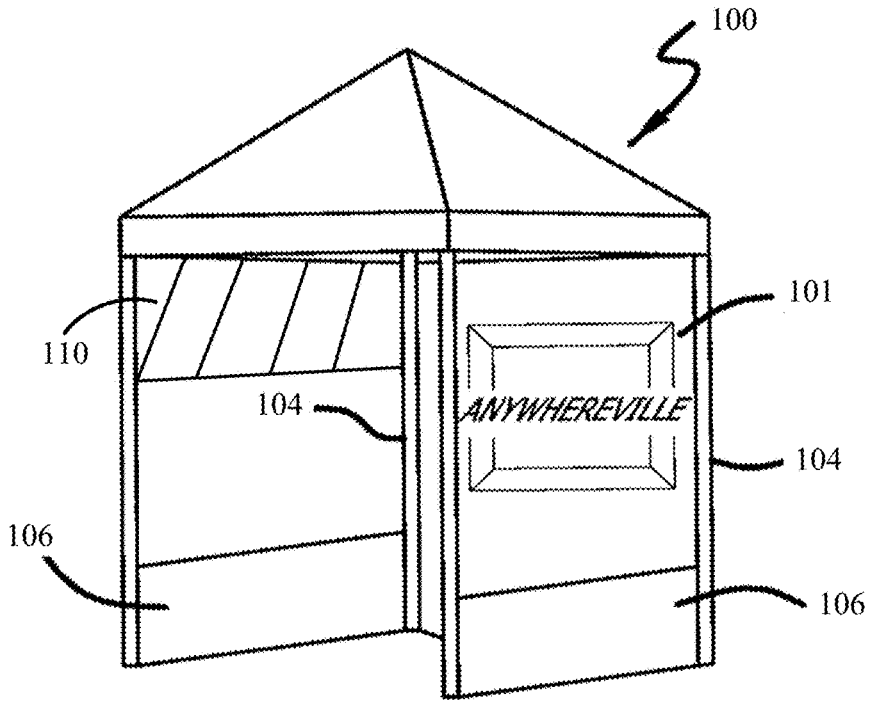
FIGS. 1A and 1B illustrate examples of shelters with various structures attached to the frames.
Figure 1B:
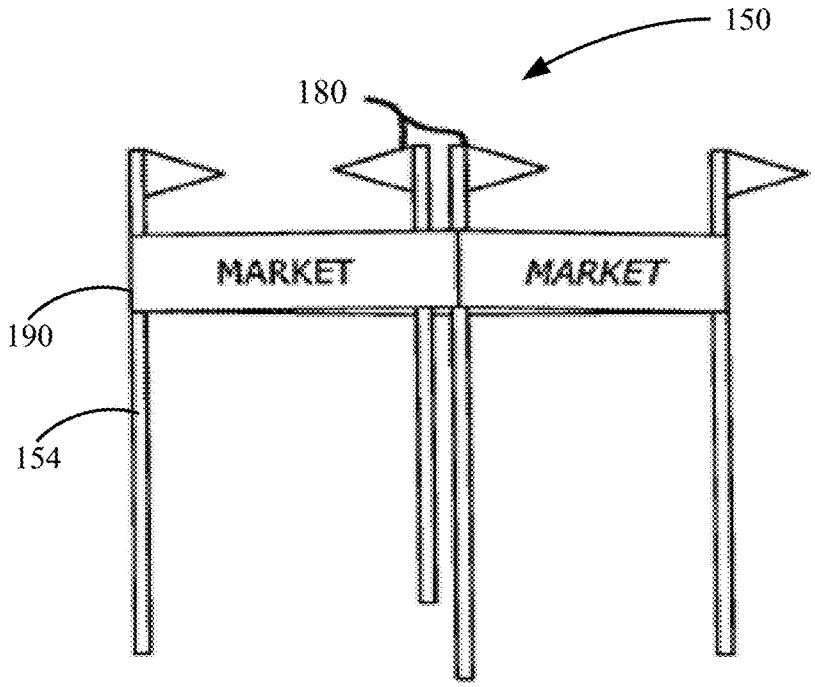

FIG. 1A illustrates an example of a conventional shelter 100 with sidewalls 101 and side skirts 106 attached to legs 104. The sidewalls 101 and side skirts 106 may be formed of a fabric material such as a polyester fabric. As previously discussed, in conventional systems, the sidewalls 101 and side skirts 106 may attach directly to the legs 104 or perimeter truss via a connection, such as a fastener attached to a strap. The connections are neither secure nor taut. Therefore, the sidewalls 101 and side skirts 106 are prone to sagging or disconnecting from the legs 104. Additionally, or alternatively, banners, flags, and/or other types of dressings may be mounted to the legs and/or frame. As an example, half walls 110 may also be mounted to the legs 104. FIG. 1B illustrates example of a booth structure 150 with flags 180 and banners 190, which may be mounted to legs 154.

As shown in FIGS. 1A and 1B, the sidewalls 101, side skirts 106, flags 180, and banners 190 are visible from the exterior of the shelter 100. The sidewalls 101, side skirts 106, flags 180, and banners 190 may have information printed on both sides. Still, there is unused space on the interior of a shelter's dome (e.g., ceiling). Still, the space on the interior of the shelter's dome may also be used to provide information (e.g., advertisements). Conventional fastening systems do not provide a system for attaching structures, such as flags and banners to an interior of the shelter.

It is desirable to provide a system to improve a customer's ability to attach various structures to a shelter. Aspects of the present disclosure are directed to a multi-point attachment system that provides multiple points in a shelter for securely fastening a structure, such as a flag, banner, side skirt, tent, etc., to the shelter's frame. According to aspects of the present disclosure, the multi-point attachment system provides a solution for a customer to attach different structures to the interior and/or exterior of the frame.

In one configuration, the multi-point attachment system provides attachment points at a center of a shelter as well as corners of the shelter. Of course, aspects of the present disclosure are not limited to providing attachment points at the center and all corners, as various configurations are contemplated based on a customer's need.

Some shelters may have a roof structure that is elevated with a telescoping peak beam. The peak beam may be connected to a bracket (e.g., center bracket) with multiple sockets. The sockets may receive one end of the peak beam as well as ends of truss links. In one configuration, one or more attachment points are provided at the center bracket.

Figure 2:
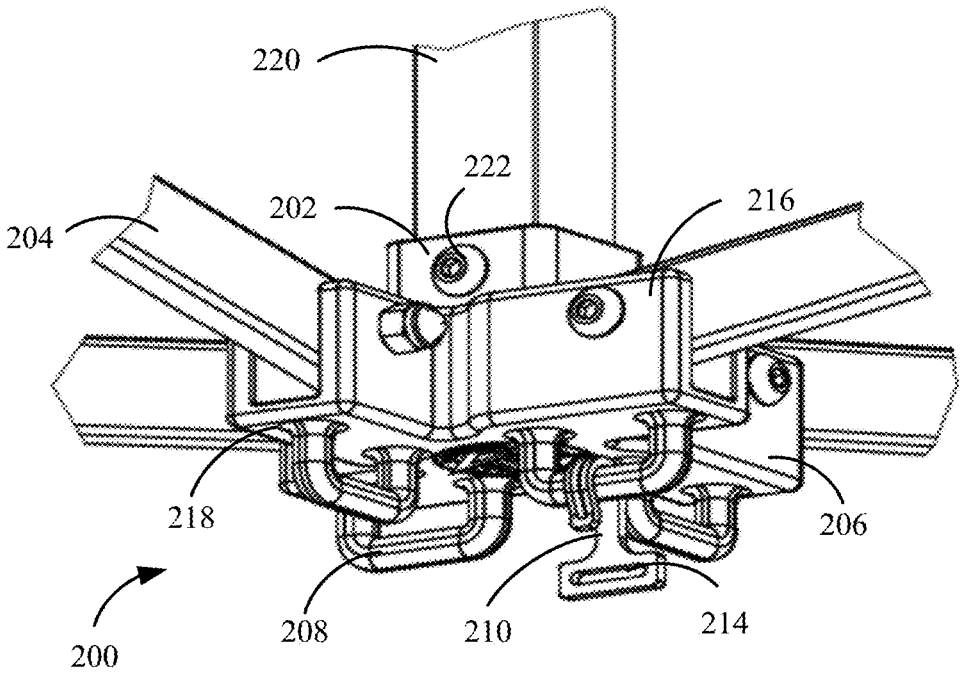
FIG. 2 illustrates an example of an element of a multi-point fixed attachment system according to aspects of the present disclosure.

FIG. 2 illustrates an example of a center bracket 200 according to aspects of the present disclosure. As shown in FIG. 2, an end of a peak beam 220 is coupled to a center socket 202 of the center bracket 200. The end of the peak beam 220 may be secured to the center socket 202 via a bolt 222 or other type of fastener. The center socket 202 may be a square shaped socket for receiving an end of the peak beam 220. Of course, the center socket 202 may have other shapes, such as a circle or other parallelogram, based on a shape of the peak beam 220.

Additionally, the center bracket 200 includes multiple side sockets 206 extending from the body of the center bracket 200. In one configuration, each socket is at substantially right angles from an adjacent socket 206. FIG. 2 illustrates the center bracket 200 with four sockets 206. Aspects of the present disclosure are not limited to the center bracket 200 with four sockets 206 as more or fewer sockets 206 are contemplated.

Each socket 206 is coupled to a truss link 204 via a bolt 222 or other type of fastener. The truss links 204 may pivot within the respective sockets 206. In one configuration, to allow a truss link 204 to pivot when coupled to a socket 206, the sockets 206 include three sides (e.g., two arms 216 and a base 218). Furthermore, as shown in FIG. 2, a handle 208 is attached to each socket 206. In one configuration, the handle 208 is U-shaped and is attached to an outer side of the base 218. The inner side of the base 218 refers to a side that is adjacent to a truss link 204. Aspects of the present disclosure are not limited to the handles 208 having a u-shape and are contemplated for other designs that allow for a fastener 210, or other apparatus, to attach to the handle. Aspects of the present disclosure are not limited to the handles 208 being attached to the outer side of the base 218 and are contemplated for the handles 208 being attached to other portions of the center bracket 200.

As shown in FIG. 2, the fastener 210 is attached to the handle 208. As an example, the fastener 210 may be a hook, clasp, clip, or other type of structure to be coupled with the handle 208 of the socket 206. An opening 214 of the fastener 210 may receive a connector from a dressing, such as a wall, sidewall, skirt, flag, and/or banner. That is, the opening 214 is specified to receive a strap or material connected to a dressing, such as a wall, sidewall, skirt, flag, and/or banner.

Figure 3:
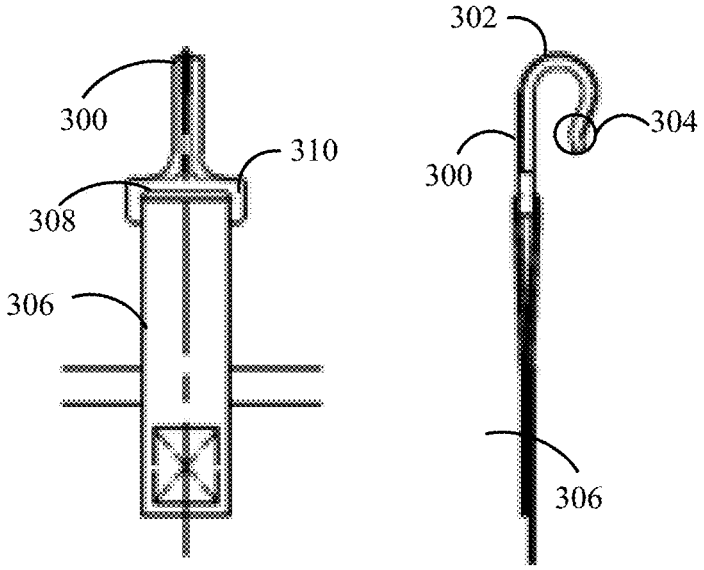
FIG. 3 illustrates an example of a connector for a multi-point fixed attachment system according to aspects of the present disclosure.

FIG. 3 illustrates an example of a fastener 300 according to aspects of the present disclosure. In one configuration, the fastener 300 is provided for attaching a dressing or structure to an attachment point, such as a handle of a bracket. As shown in FIG. 3, the fastener 300 includes a hook portion 302 that curves at a top of the fastener 300. A portion of the fastener 300 extends outward at the nose of the hook portion 302 to form a V-shaped end 304 for the fastener 300. As previously discussed, the fastener 300 is adapted to clip to a handle of a bracket. The V-shaped end 304 improves the retainment of the fastener 300 with a handle (e.g., attachment) of a multi-point attachment system.

Furthermore, as shown in FIG. 3, in one configuration, a strap 306 is extended through an opening 308 of the fastener 300. The opening 308 may be defined in a rectangular shaped end 310 of the fastener 300. Of course, aspects of the present disclosure are not limited to the fastener 300 having a rectangular shaped end 310 as other shapes are contemplated. The strap 306 may be sewn (e.g., connected) to a material of a dressing, such as a sidewall or skirt. Aspects of the present disclosure are also contemplated for the strap 306 to be connected to material of other structures, such as a tent, a flag, an inner wall extending along the roof of the canopy, or any other type of dressing (e.g., structure/fabric/material). In one configuration, the length of the strap 306 is adjustable.

Figure 4A:
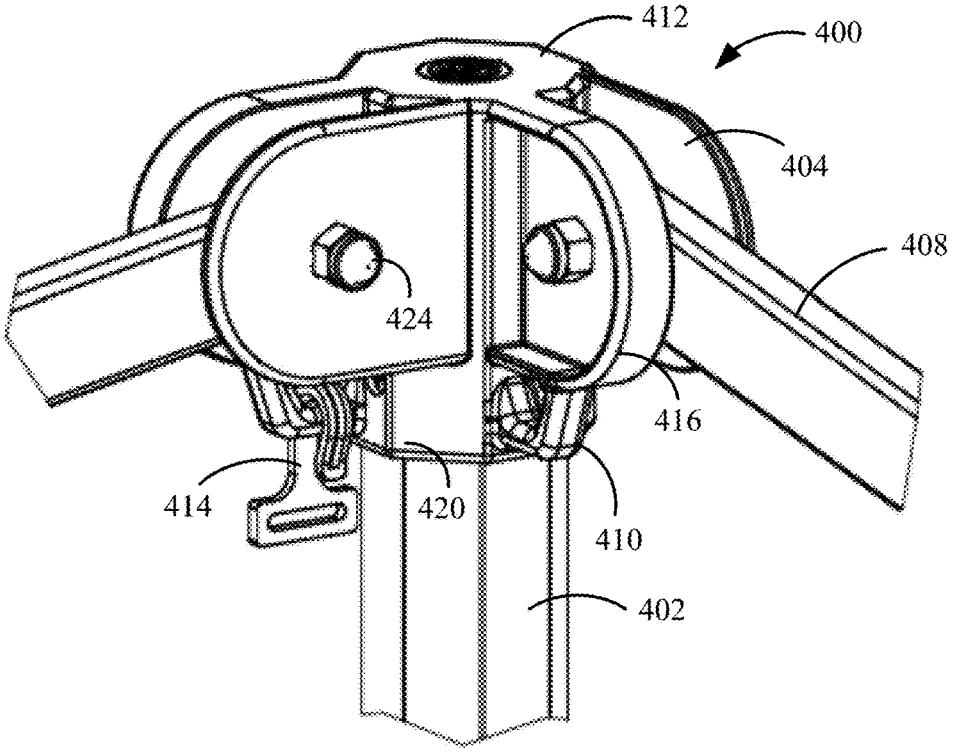
FIGS. 4A and 4B illustrate examples of elements of a multi-point fixed attachment system according to aspects of the present disclosure.
Figure 4B:
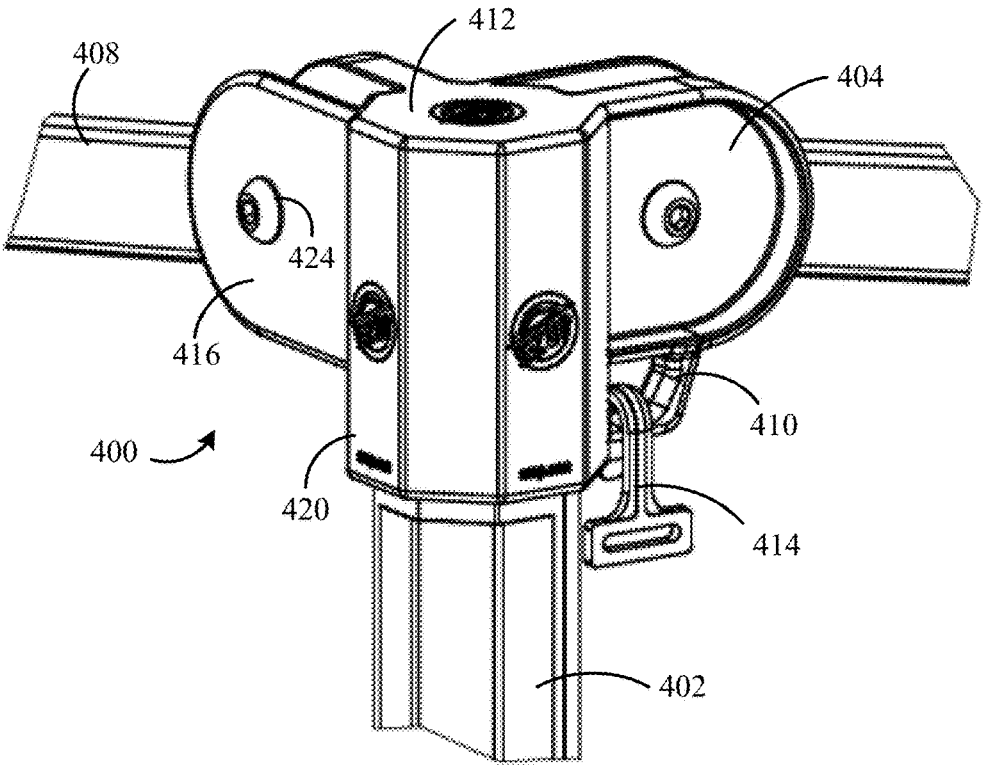

As previously discussed, a center bracket may include attachment points (e.g., handles) for a multi-point attachment center. In one configuration, attachment points are defined on leg brackets of a shelter. The attachment points on the leg brackets may be provided alternate to or in addition to the attachment points of the center bracket. FIGS. 4A and 4B illustrate examples of different views of a leg bracket 400 according to aspects of the present disclosure. FIG. 4A illustrates a first view (e.g., front view) of the leg bracket 400 and FIG. 4B illustrates a second view (e.g., back view) of the leg bracket 400. The second view is opposite of the first view. As shown in FIGS. 4A and 4B, the leg bracket 400 is connected to a leg 402 of the collapsible frame. That is, a socket 420 of the leg bracket 400 receives an end of the leg 402. The leg 402 may be attached to the socket 420 via a bolt or other attachment (not shown).

The leg bracket 400 includes multiple sockets 404 extending outward from a body 412 of the leg bracket 400. Each socket 404 may be at substantially right angle from an adjacent socket 404. Aspects of the present disclosure are not limited to two sockets 404 as shown in FIGS. 4A and 4B; the leg bracket 400 may have one or more sockets 404. For example, in one configuration, the leg bracket 400 includes only one socket 404 extending outward from a body 412 of the leg bracket 400.

An end of a link member 408 is received in each socket 404 of the leg bracket 400. The end of the link member 408 may be pivotally connected to the socket 404. Specifically, the end of the link member 408 may be attached to the socket via a bolt 424 or other attachment. The socket 404 of the leg bracket 400 includes two arms 416. As a roof and a floor are not defined for each socket 404 of the leg bracket 400, the link member 408 may pivot in an up or down direction.

In one configuration, a handle 410 (e.g., attachment point) is defined below each socket 404. A first end of the handle 410 may be attached to a bottom of one arm 416 of the socket 404 and a second end of the handle 410 may be attached to the body 412 of the leg bracket 400. Each handle 410 may be adaptable to receive a fastener 414. As previously discussed, the fastener 414 is adapted to be connected to material of a structure via a strap or other type of connector. The leg bracket 400 is not limited to receiving link members and may receive telescoping pole members or other structures of a frame of a shelter.

Figure 5A:
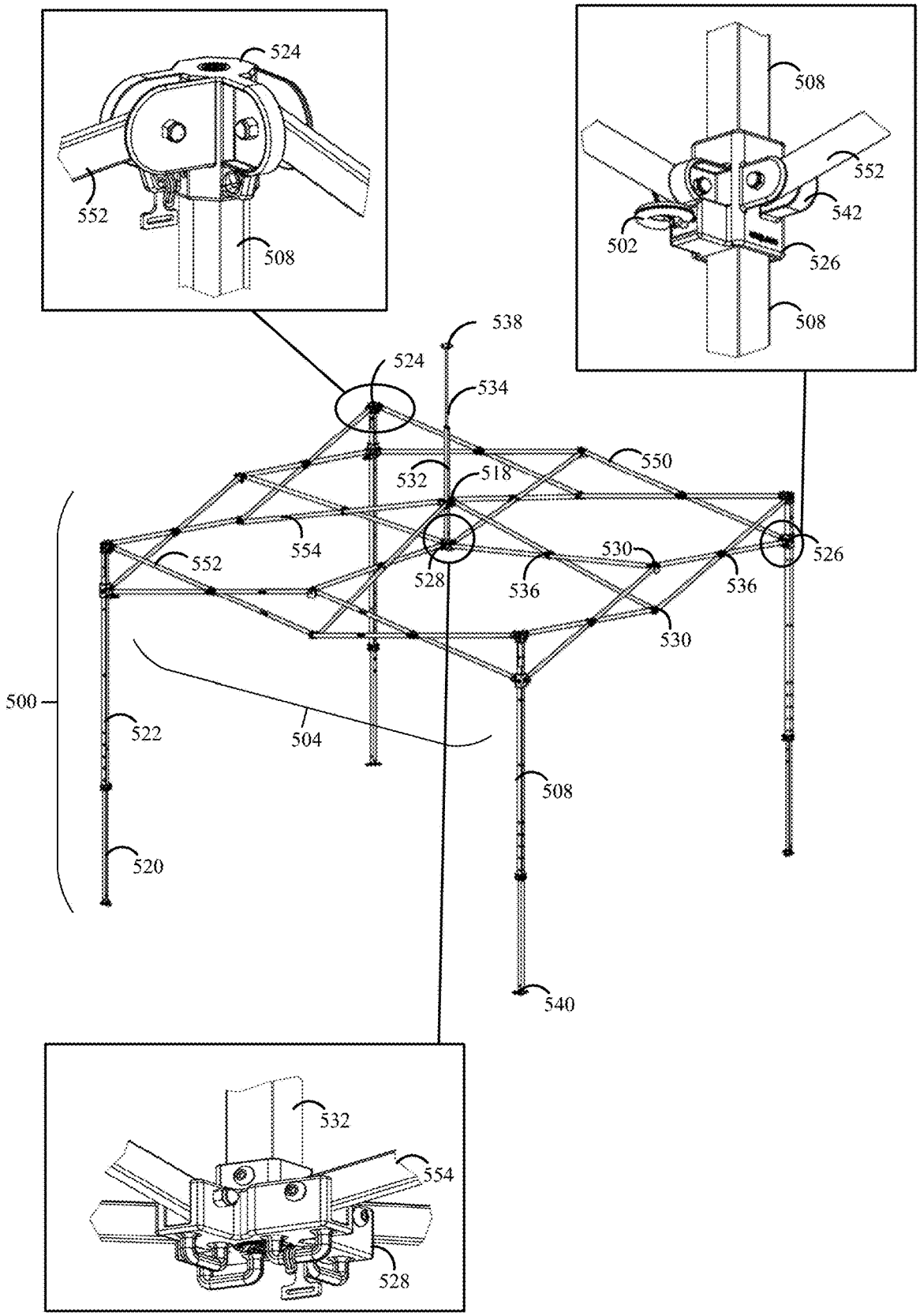
FIGS. 5A, 5B, 6A, 6B, and 7 illustrate examples of collapsible frames according to aspects of the present disclosure.

FIG. 5A illustrates an example of a frame of a shelter 500 in accordance with aspects of the present disclosure. The shelter 500 may be a modular folding shelter, such as a display booth. As shown in FIG. 5A, the frame has four sides 504 and four corners. Each side 504 may be substantially perpendicular to one or more adjacent sides 504. Of course, aspects of the present disclosure are not limited to a frame with four sides and four corners, as other configurations, such as three sides and three corners, are also contemplated. Additionally, adjacent sides 504 may be connected at an angle that is greater than or less than 90 degrees. The frame may be collapsible. In another configuration, the frame is fixed.

In one configuration, legs 508 are provided at each corner to erect the frame. The legs 508 may be telescoping (e.g., extendable). That is, each leg 508 may comprise a telescoping lower section 520 that extends from a hollow upper section 522. The telescoping lower section 520 may be slidably disposed within the telescoping lower section 520. Each telescoping lower section 520 has a foot 540 for engagement with the ground. Additionally, a perimeter truss frame 550 is connected to the legs 508 via brackets 524, 526 to stabilize and support the frame of the shelter 500. The perimeter truss frame 550 may also be referred to as a perimeter truss framework.

The perimeter truss frame 550 may include multiple outer truss links 552 and multiple inner truss links 554. Two outer truss links 552 may form an outer truss link pair. The outer truss links 552 of each outer truss link pair may be pivotally connected to each other at a cross-link joint 536, such as in a scissor configuration. In one configuration, a first end of each outer truss link 552 is pivotally connected to a leg 508 via either a leg bracket 524 or a sliding bracket 526. That is, a first end of one outer truss link 552 of each outer truss link pair may be pivotally connected to a socket of the leg bracket 524. Each socket of the leg bracket 524 may include an attachment point (e.g., handle) for receiving a fastener (see FIGS. 4A-B). The first end of another outer truss link 552 of each outer truss link pair may be pivotally connected to a socket of a sliding bracket 526, such that one outer truss link 552 of an outer truss link pair is slidably connected to a corresponding leg 508. A second end of each outer truss link 552 may be connected to a second end of another outer truss link 552 at an outer joint 530. The outer joint 530 may be a three-way joint.

As shown in FIG. 5A, two inner truss links 554 may be pivotally connected at a cross-link joint 536 to form an inner truss link pair. Two inner truss links 554 may be pivotally connected, such as in the scissor configuration. In one configuration, a first end of a first inner truss link 554 is pivotally connected to a second end of two outer truss links 552 at an outer joint 530. A second end of the first inner truss link 554 of each inner truss link pair is pivotally connected to a peak slider 518. Furthermore, a first end of a second inner truss link 554 of each inner truss link pair is pivotally connected to a second end of two outer truss links 552 at an outer joint 530. A second end of the second inner truss link 554 of each inner truss link pair is pivotally connected to a socket of the center bracket 528. Each socket of the center bracket 528 may include an attachment point (e.g., handle) for receiving a fastener (see FIG. 2).

The shelter 500 may include a peak beam 532 for supporting a roof structure (not shown), such as a canopy. The peak beam 532 may be attached to a center bracket 528. The peak slider 518 may also be slidably attached to the peak beam 532. In one configuration, a peak pole 534 is telescoping (e.g., extendable) from the peak beam 532. That is, the peak beam 532 may be hollow so that the peak pole 534 may extend upward from the peak beam 532. The peak pole 534 may be slidably disposed within the peak beam 532. Additionally, the peak pole 534 may include a top bracket 538 for engaging a roof structure, such as a canopy.

The top bracket 538 may also include attachment points. In one configuration, a sail banner may be attached to an attachment point of the top bracket 538 and an attachment point on one or more leg brackets 524. Additionally, or alternatively, the sail banner may be attached to other components of the shelter. The sail banner may be used to display information on the interior of the shelter 500. In one configuration, a roof material may be placed on the shelter 500. In this configuration, the roof structure is placed over the sail banner, such that only the roof structure is visible from the exterior of the shelter 500, while both the roof structure and the sail banner are visible from the interior of the shelter 500.

FIG. 5A illustrates an example of a sliding bracket 526 according to aspects of the present disclosure. As shown in FIG. 5A, a leg 508 passes through an opening of the sliding bracket 526. A pin 502 is used to engage the sliding bracket 526 with an opening in the leg 508 to keep the sliding bracket 526 in a desired position. The sliding bracket 526 includes one or more sockets 542 for engaging an end of a truss link, such as an outer truss link 552. A truss link may pivot within the socket 542. In one configuration, the sliding bracket 526 includes one or more attachment points of the multi-point attachment system.

Figure 5B:
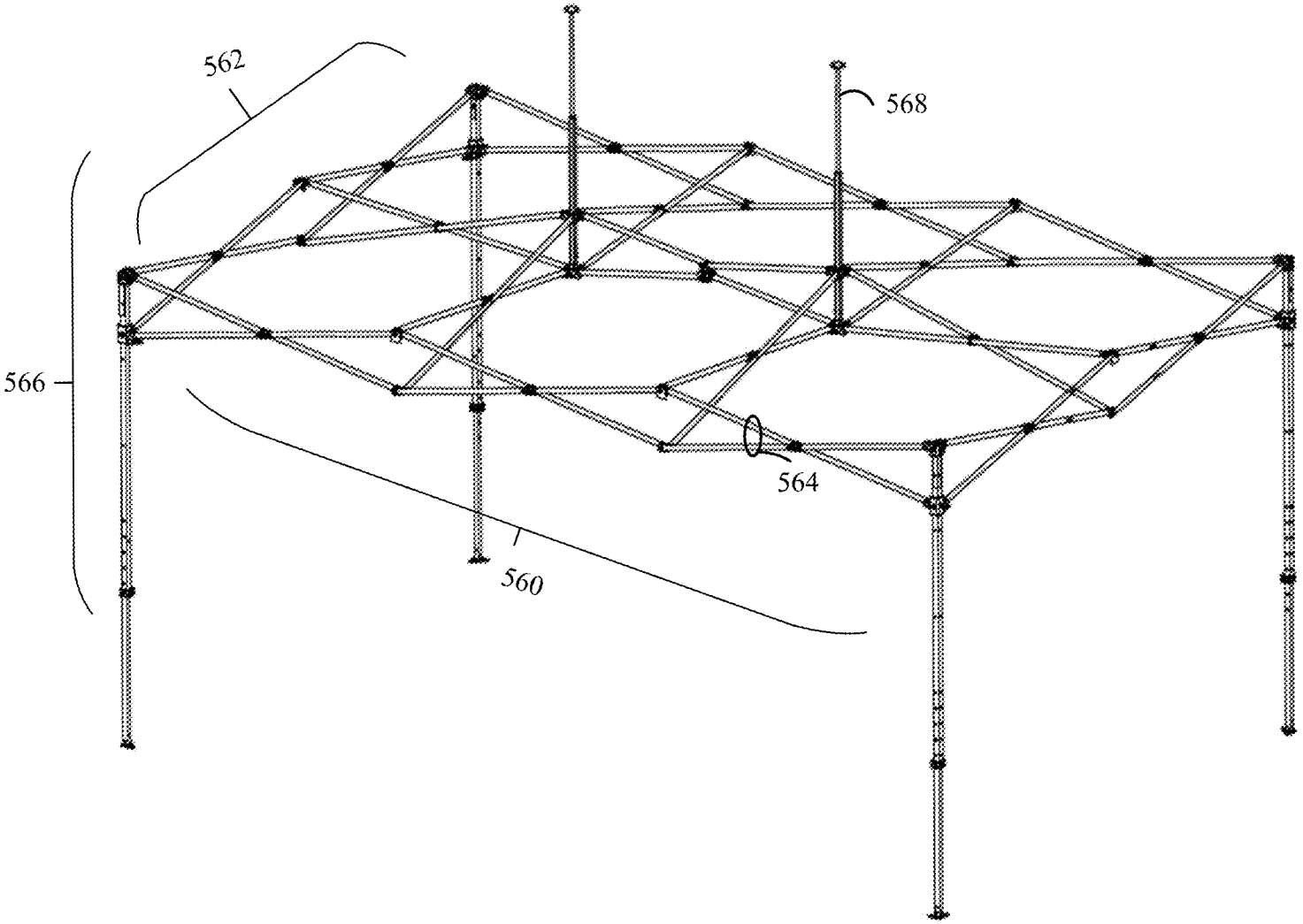

Aspects of the present disclosure are not limited to two outer truss link pairs per side. The number of outer truss link pairs, per side, may be less than or greater than two. For example, as shown in FIG. 5B, a first side 560 of a shelter 566 may include three outer truss link pairs 564 and a second side 562 may include two outer truss link pairs 564. In this example, the shelter 566 may include multiple peak beams 568. The other portions of the frame of the shelter 566 are similar to the frame of the shelter 500 of FIG. 5A. For brevity, the elements of the shelter 566 of FIG. 5B that are the same as the elements of the shelter 500 of FIG. 5A will not be discussed in detail.

Figure 6A:
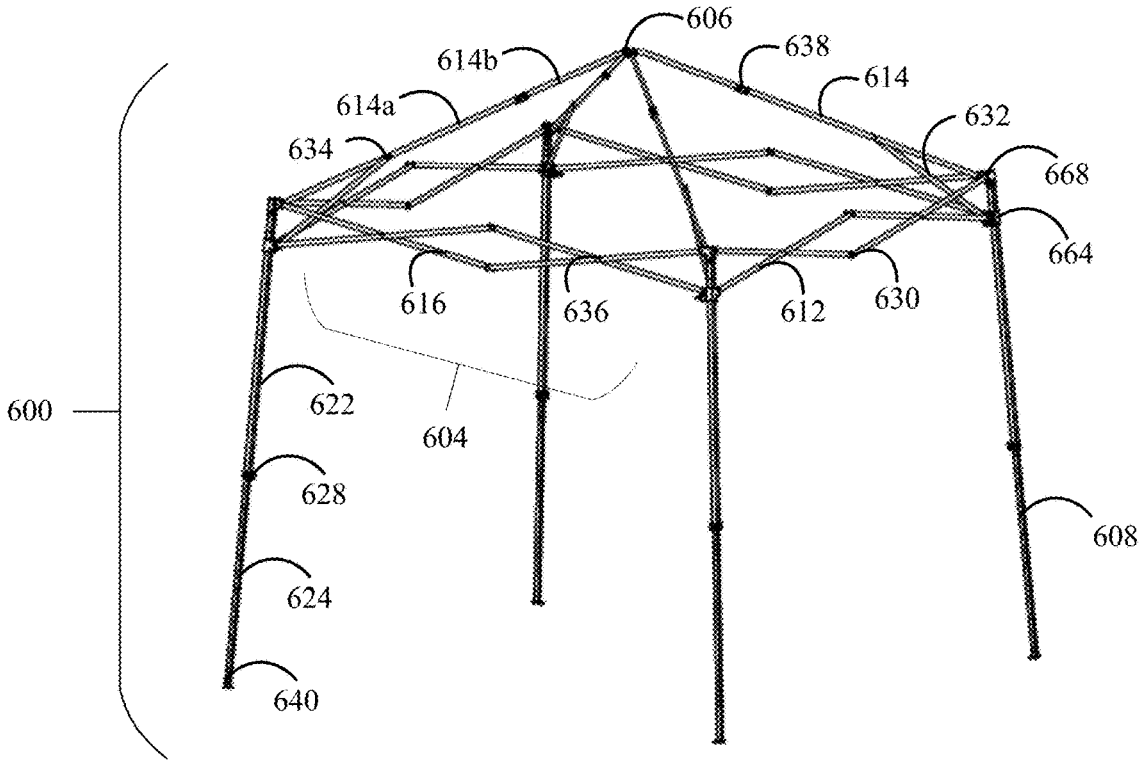

Aspects of the present disclosure are not limited to the shelters of FIGS. 5A and 5B as other types of shelters may be used for the multi-point attachment system. FIG. 6A illustrates an example of a frame for a shelter 600 with a peak shaped roof in accordance with aspects of the present disclosure. The shelter 600 may be a modular folding shelter, such as a display booth. As shown in FIG. 6A, the shelter 600 has four sides 604 and four corners. Each side 604 may be substantially perpendicular to one or more adjacent sides 604. Of course, aspects of the present disclosure are not limited to a shelter 600 with four sides and four corners, as other configurations are also contemplated. The shelter 600 may be collapsible.

In one configuration, legs 608 are provided at each corner to erect the shelter 600. The legs 608 may be telescoping (e.g., extendable). That is, each leg 608 may comprise a telescoping lower section 624 that extends from a hollow upper section 622. The telescoping lower section 624 may be slidably disposed within the hollow upper section 622. A slider 628, such as a slider with a pull pin, may be used to extend the telescoping lower section 624 from the hollow upper section 622. Each telescoping lower section 624 has a foot 640 for engagement with the ground. Additionally, a perimeter truss frame 616 is connected to the legs 608 for stability and support.

The perimeter truss frame 616 may include multiple outer truss links 612. Two pivotally connected outer truss links 612 may form an outer truss link pair. The outer truss links 612 of each outer truss link pair may be pivotally connected to each other at a cross-link joint 636, such as in a scissor configuration. In one configuration, a first end of each outer truss link 612 is pivotally connected to a leg 608 via a sliding bracket 664 or a leg bracket 668. Specifically, the first end of one outer truss link 612 of each outer truss link pair may be pivotally connected to a socket of a sliding bracket 664. The first end of another outer truss link 612 of each outer truss link pair may be pivotally connected to a socket of the leg bracket 668, such that each outer truss link 612 is pivotally connected to a corresponding leg 608. The leg bracket 668 and/or the sliding bracket 664 may include one or more attachment points (see FIGS. 4A-B). A second end of each outer truss link 612 may be connected to a second end of another outer truss link 612 at an outer joint 630.

As shown in FIG. 6A, the frame may include multiple upper peak truss links 614 and lower peak truss links 632. A first end of each upper peak truss link 614 may be pivotally connected to a leg bracket 668. A second end of each upper peak truss link 614 may be pivotally connected to a peak center bracket 606. The peak center bracket 606 may include one or more attachment points of the multi-point attachment system. Each upper peak truss link 614 may also include a peak joint 638, such that a first portion 614*a* and a second portion 614*b* of each first peak truss link 614 are foldable. A first end of a lower peak truss link 632 may be pivotally connected to the upper peak truss link 614 at a truss joint 634. A second end of the lower peak truss link 632 may be pivotally connected to socket of a sliding bracket 664. Each socket of a sliding bracket 664 may include a handler for receiving a fastener.

The lower peak truss links 632 may provide support to a corresponding (e.g., adjacent) upper peak truss link 614. The upper peak truss links 614 form a peak for supporting a roof structure (not shown), such as a canopy. The lower peak truss links 632 and/or upper peak truss links 614 may be made of a rigid material or flexible material. The truss links may form a dome shaped roof, a pyramid shaped roof, or other type of roof.

Figure 6B:
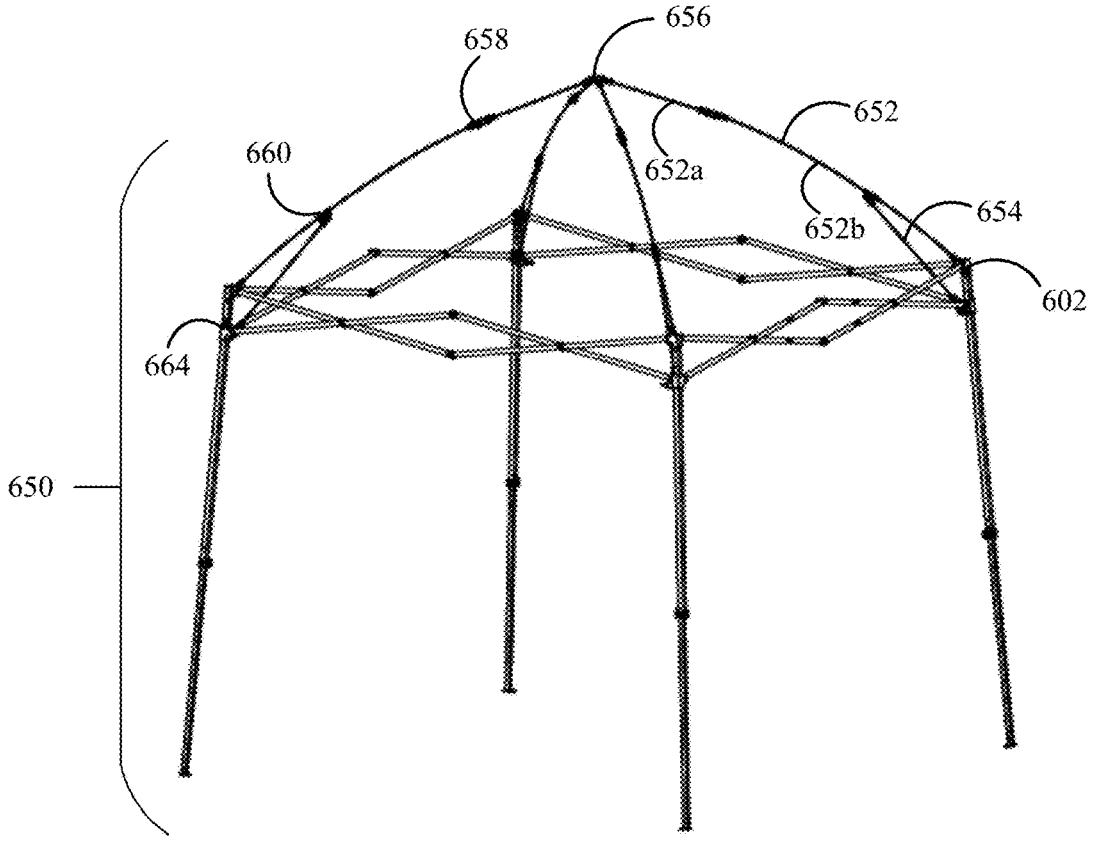

FIG. 6B illustrates an example of a frame of a shelter 650 with a dome shaped roof according to aspects of the present disclosure. The frame of the shelter 650 is similar to the frame of the shelter 600 of FIG. 6A. For brevity, the elements of the shelter 650 of FIG. 6B that are the same as the elements of the shelter 600 of FIG. 6A will not be discussed in detail.

As shown in FIG. 6B, the frame may include multiple upper peak truss links 652 and lower peak truss links 654. A first end of each upper peak truss link 652 may be pivotally connected to a leg bracket 602. The leg bracket 602 may include a handle on each socket (see FIGS. 4A-4B). A second end of each upper peak truss link 652 may be pivotally connected to a dome center bracket 656. Each upper peak truss link 652 may also include a joint 658, such that a first portion 652*a* and a second portion 652*b* of each upper peak truss link 652 are foldable. A first end of a lower peak truss link 654 may be pivotally connected to the upper peak truss link 652 at a joint 660. A second end of the lower peak truss link 654 may be pivotally connected to a socket of a sliding bracket 664.

The lower peak truss links 654 may provide support to a corresponding (e.g., adjacent) upper peak truss link 652. The upper peak truss links 652 and lower peak truss links 654 form a dome for supporting a roof structure (not shown), such as a canopy. The lower peak truss links 654 and the upper peak truss links 652 may be a flexible material. For example, the lower peak truss links 654 and the upper peak truss links 652 may be flexible rods, such as composite fiber rods. The flexibility improves wind resistance.

As an example, a tent shelter, such as a cube tent, gazebo, or a structure with a roof, may be erected within the shelter 650. In one configuration, the tent shelter may have a cube shape and the sides of the tent shelter may be attached to attachment points on the leg brackets 602. Furthermore, a strap may be attached to the roof of the structure and an attachment point of the dome center bracket 656. The dome of the shelter 650 may then be covered with a roof fabric. The flexibility of the upper peak truss links 652 as well as the connection between the roof of the tent shelter and the dome of the shelter 650 improves the wind resistance of the structure. Aspects of the present disclosure are not limited to erecting a tent shelter in shelters with flexible peak truss links, as the tent shelter may be erected in any type of shelter with a multi-point attachment system.

Figure 7:
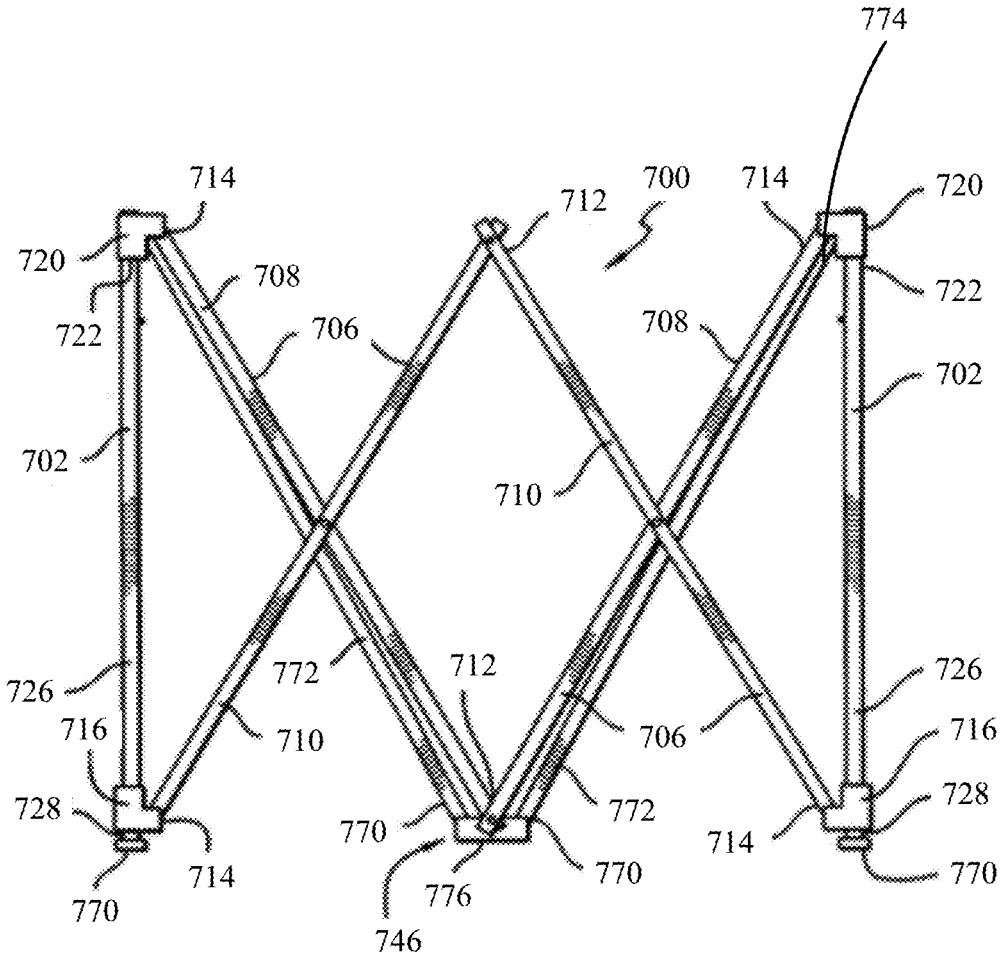

FIG. 7 illustrates an example of a shelter in a partially collapsed position. As shown in FIG. 7, a perimeter truss link assembly 700 having multiple perimeter truss pairs of link members 706 is connected to each leg 702. Each of the perimeter truss pairs including first link members 708 and second link members 710 that are pivotally connected together, such as in a scissor configuration. The first link members 708 and second link members 710 have inner ends 712 and outer ends 714. The outer end 714 of each first link member 708 connected to the upper end of one leg 702 via a leg bracket 720, and the outer end 714 of each second link member 710 being connected to a sliding leg bracket member 716 so as to be slidably connected to the leg 702. The inner ends 712 may be pivotally connected to each other. Each leg 702 may comprise a hollow upper section 726 and a telescoping lower section 728, with the lower section slidably disposed within the upper section, with the lower section having a foot section 770 for engagement with the ground. An end 722 of each leg 702 is connected to the leg bracket 720.

According to aspects of the present disclosure, a secluded area may be provided by attaching a hanging room to a portion of a shelter (e.g., collapsible shelter). In one configuration, the hanging room is attached to one or more of a peak beam, a joint, an inner truss link, and outer truss link, a leg, a bracket, and/or another portion of the shelter. The bracket may be attached to the canopy peak assembly, a joint, a leg, and/or another portion of the shelter. The hanging room may be referred to as a hanging shelter, a hanging space, a hang space, or a hang shelter.

In one configuration, the hang space is a cube with four sides. Each side may be a quadrilateral with two edges of a first substantially similar length and two other edges of a second substantially similar length. The second length is different from the first length. Aspects of the present disclosure are not limited to two edges of a first length and two edges of a second length. Each edge may have a substantially similar or different length in comparison to a length of other edges. Furthermore, the hang space is not limited to a quadrilateral, as other types of shapes are contemplated, such as a triangle or a cylinder.

Conventional shelters have an open space design. That is, the interior of the shelter is open to provide a covered space for those within the shelter. As the use of shelters has increased, there is a need to provide a secluded area within the shelter. For example, some shelters are used as temporary stores. In this example, there is a need for a merchant to provide a changing room for customers to try on clothes and/or a secluded area for storage. In yet another example, a shelter may need a dark room to process film. In still yet another example, a shelter may need a secluded area for a crime scene investigation. As discussed herein, there are various needs for a secluded area within a shelter.

Aspects of the present disclosure are directed to a hang space that provides a secluded area within a shelter. The hang space may be attached to the interior of the shelter. In one configuration, attachments of the hang space are adjustable, such that the hang space is adjusted to be taut when attached to the shelter. The hang space may be connected to an upper portion of the shelter, such as the truss links. The hang space may also include attachments for securing the hang space to the ground.

Figure 8A:
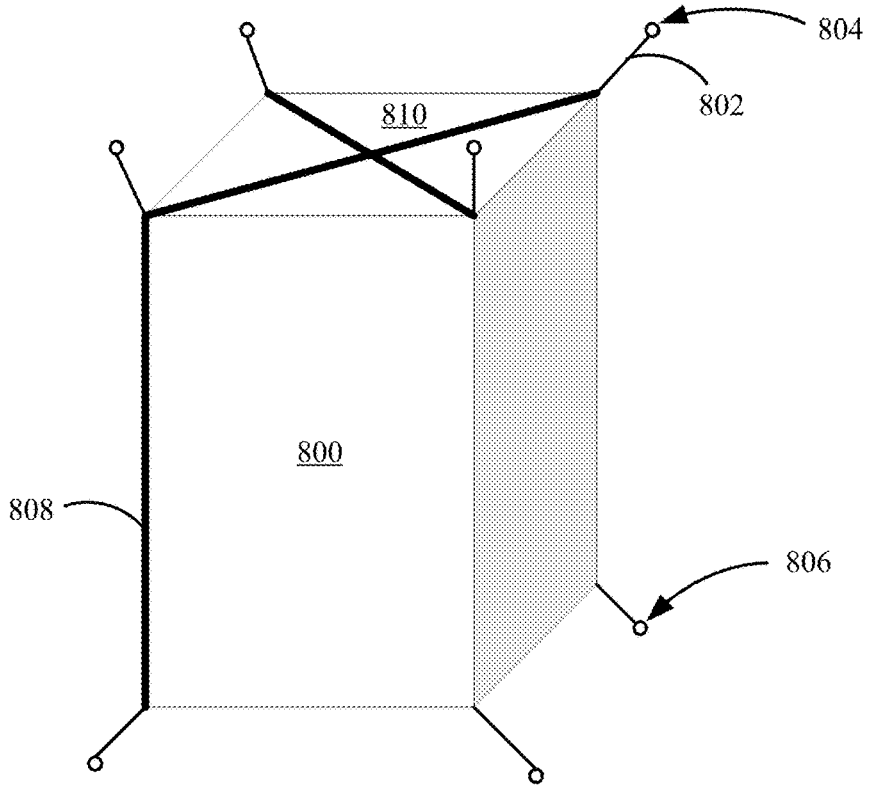
FIGS. 8A, 8B, 8C, 9, and 10 illustrate examples of hanging rooms according to an aspect of the present disclosure.

FIG. 8A illustrates an example of a square hang space 800 according to an aspect of the present disclosure. As shown in FIG. 8A, multiple straps 802 may be connected (e.g., sewn) to a material of the square hang space 800. Additionally, a fastener may be connected to each strap 802. In one configuration, top fasteners 804 on a top portion of the square hang space 800 are different from bottom fasteners 806 on a bottom portion of the square hang space 800. For example, the top fasteners 804 may be hooks (see FIG. 3) for attaching to a truss link or a handle of a bracket. Additionally, the bottom fasteners 806 may be rings for receiving a stake to secure the bottom fasteners 806 to the ground.

One or more edges of the square hang space 800 may be detachable to allow access to an interior portion of the square hang space 800. For example, a connector 808 may connect two adjacent sides or two parts of the same side. The connector 808 may be a zipper, hook and loop fastener (e.g., VELCRO™), buttons, hooks, or other type of connector. The connector 808 may be placed on an edge or on one of the sides of the square hang space 800. Additionally, a roof 810 of the square hang space 800 may be covered or may be open.

Figure 8B:
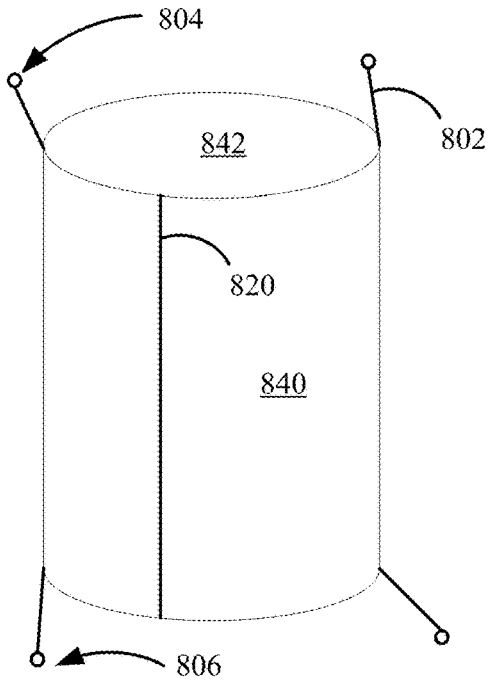

FIG. 8B illustrates an example of a cylinder hang space 840 according to an aspect of the present disclosure. As shown in FIG. 8B, multiple straps 802 may be sewn (e.g., connected) to a material of the cylinder hang space 840. Additionally, a fastener may be connected to each strap 802. In one configuration, top fasteners 804 on a top portion of the cylinder hang space 840 are different from bottom fasteners 806 on a bottom portion of the cylinder hang space 840. For example, the top fasteners 804 may be hooks (see FIG. 3) for attaching to a truss link or a handle of a bracket. Additionally, the bottom fasteners 806 may be rings for receiving a stake to secure the bottom fasteners 806 to the ground.

The cylinder hang space 840 may include a connector 820 for connecting two edges of a side of the cylinder hang space 840. That is, the connector 820 may detach one edge from another edge to allow access to an interior portion of the cylinder hang space 840. For example, the connector 820 may be a zipper, hook and loop fastener, buttons, hooks, or another type of connector for connecting connect one side to an adjacent side. Additionally, a roof 842 of the cylinder hang space 840 may be covered or may be open.

Figure 8C:
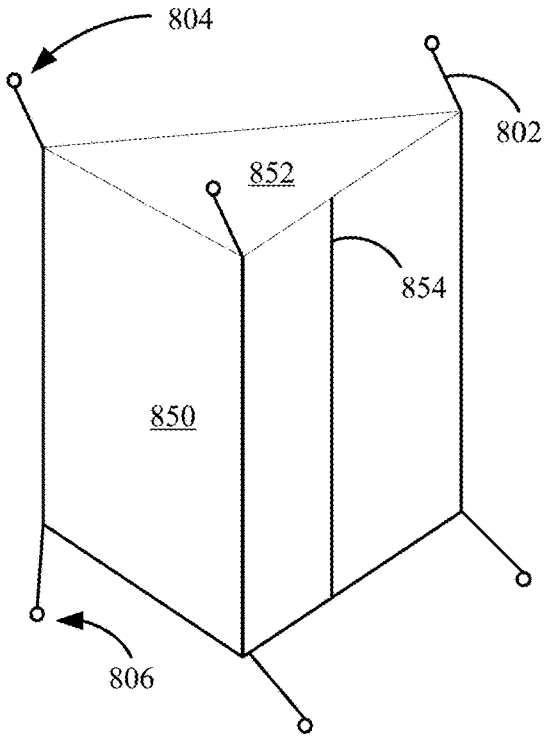

FIG. 8C illustrates an example of a triangle hang space 850 according to an aspect of the present disclosure. As shown in FIG. 8C, multiple straps 802 may be sewn (e.g., connected) to a material of the triangle hang space 850. Additionally, a fastener may be connected to each strap 802. In one configuration, top fasteners 804 on a top portion of the triangle hang space 850 are different from bottom fasteners 806 on a bottom portion of the triangle hang space 850. For example, the top fasteners 804 may be hooks (see FIG. 3) for attaching to a truss link or a handle of a bracket. Additionally, the bottom fasteners 806 may be rings for receiving a stake to secure the bottom fasteners 806 to the ground.

The triangle hang space 850 may include a connector 854 for connecting two edges of a side of the triangle hang space 850. That is, the connector 854 may detach one edge from another edge to allow access to an interior portion of the triangle hang space 850. For example, the connector 854 may be a zipper, hook and loop fastener, buttons, hooks, or another type of connector for connecting connect one side to an adjacent side. The connector 854 may be placed on an edge or on one of the sides of the triangle hang space 850. Additionally, a roof 852 of the triangle hang space 850 may be covered or may be open.

Figure 9:
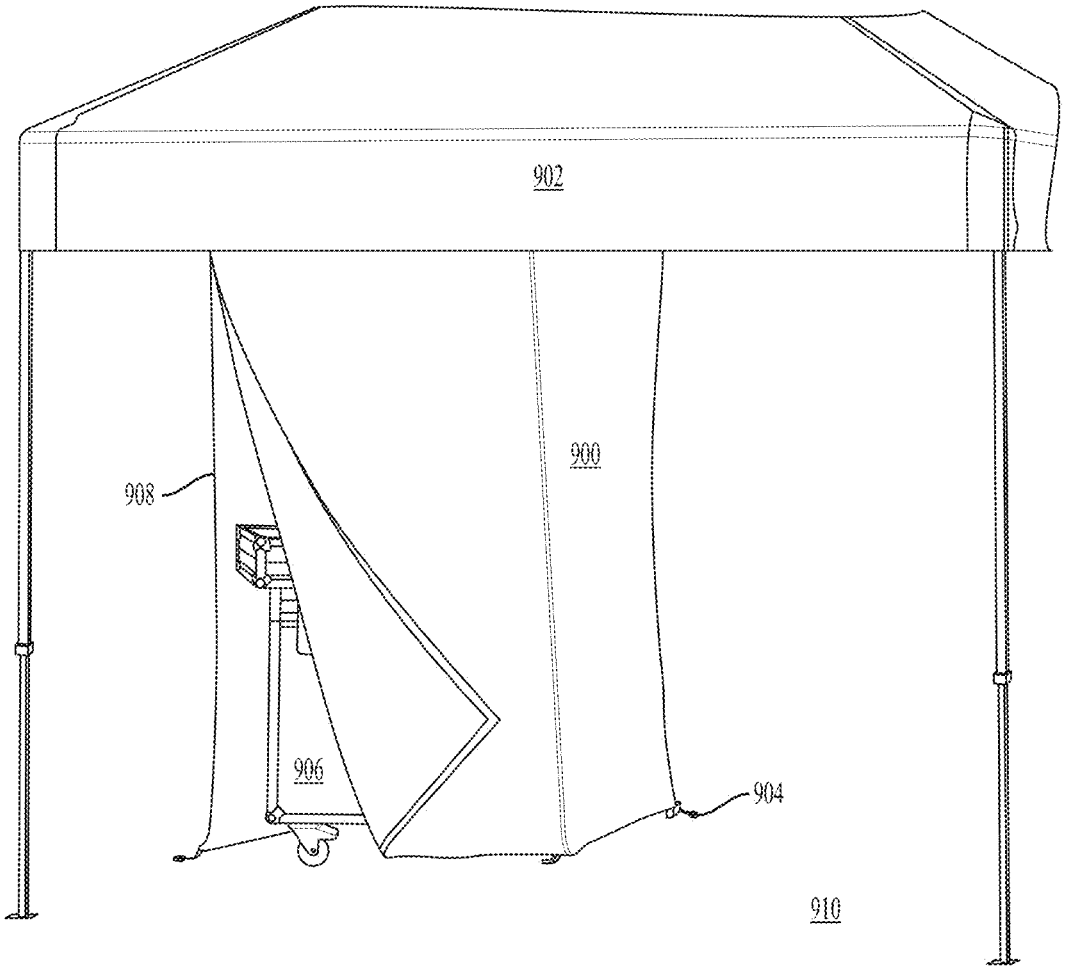

FIG. 9 illustrates an example of a hang space 900 according to aspects of the present disclosure. In this example, the hang space 900 is attached to a portable shelter 902 and hangs to the ground 910. Bottom connectors 904 may be attached to the ground 910. The hang space 900 includes a connector 908 for connecting one side of the hang space 900 to an adjacent side. As shown in FIG. 9, the connector 908 may detach one side of the hang space 900 from an adjacent side of the hang space 900 to provide access to an interior of the hang space 900. Additionally, the connector 908 attaches one side of the hang space 900 to the adjacent side of the hang space 900 to conceal the interior area of the hang space 900. In this example, equipment 906 is stored in the interior of the hang space 900.

Figure 10:
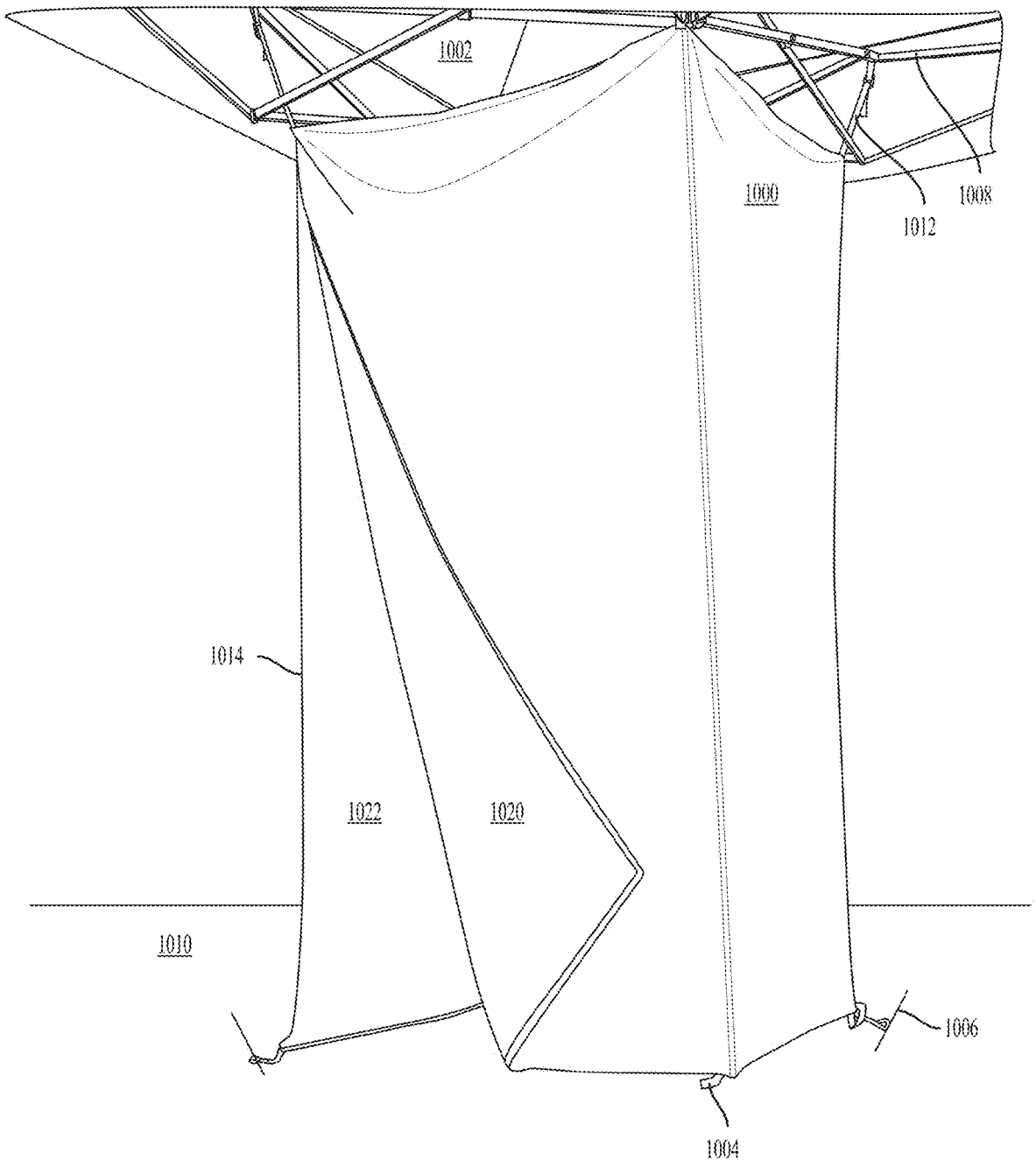

FIG. 10 illustrates an example of a hang space 1000 according to aspects of the present disclosure. In this example, the hang space 1000 is attached to a portable shelter 1002 and hangs to the ground 1010. Bottom connectors 1004 may be attached to the ground 1010. For example, the bottom connectors 1004 may be attached to the ground 1010 via stakes 1006. The hang space 1000 may be attached to truss links 1008 of the shelter 1002 via top connectors 1012. Each top connector 1012 may include a fastener to hook onto a truss link 1008. The top connector 1012 may also be attached to a corner or center bracket (not shown).

The hang space 1000 includes a connector 1014 for connecting one side 1020 of the hang space 1000 to an adjacent side 1022. As shown in FIG. 10, the connector 1014 may detach one side 1020 from the adjacent side 1022 to provide access to an interior of the hang space 1000. Additionally, the connector 1014 attaches one side 1020 to the adjacent side 1022 to conceal the interior area of the hang space 1000.

Figure 11:
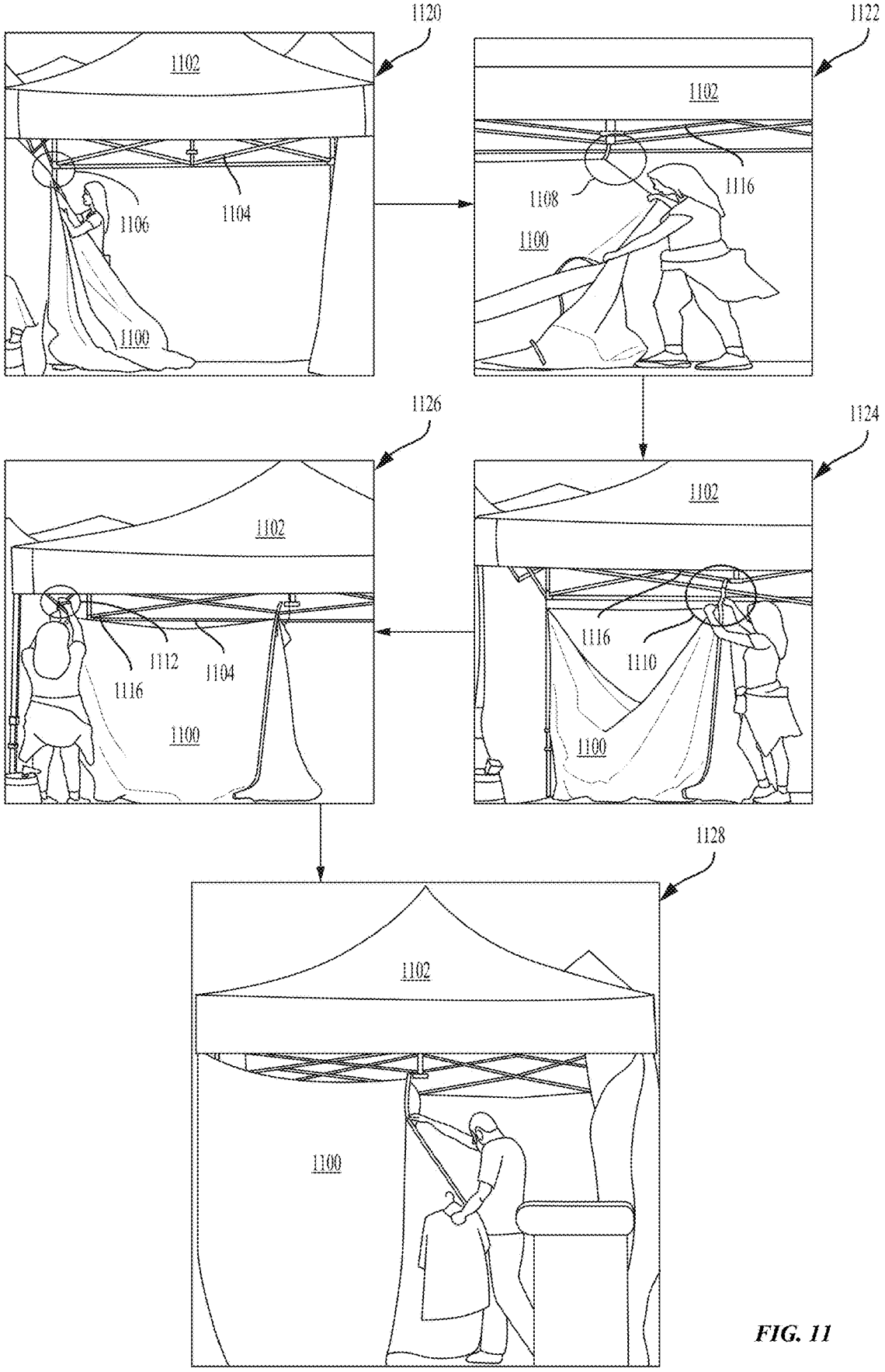
FIGS. 11 and 12 illustrate examples of attaching a hang room to a shelter according to aspects of the present disclosure.

FIG. 11 illustrates an example of attaching a hang space 1100 to a shelter 1102 according to aspects of the present disclosure. As shown in FIG. 11, at block 1120, a first corner 1106 of the hang space 1100 is attached to an outer truss link 1104 of the shelter 1102. The outer truss links 1104 form an upper perimeter of the shelter 1102. Each corner of the hang space 1100 includes a strap with a fastener. The fastener may be attached to an outer truss link 1104, corner brace, center brace, joint, leg, or another structure of the shelter 1102.

At block 1122, a second corner 1108 of the hang space 1100 is attached to an inner truss link 1116 of the shelter 1102. Additionally, at block 1124 a third corner 1110 of the hang space 1100 is attached to an inner truss link 1116 of the shelter 1102. Furthermore, at block 1126, a fourth corner 1112 of the hang space 1100 is attached to an inner truss link 1116 or an outer truss link 1104 of the shelter 1102. Finally, at block 1128 the hang space 1100 is ready for use. As shown at block 1128, the hang space 1100 is relatively taut. In one configuration, each strap may be adjusted to provide tautness to the hang space 1100.

Furthermore, as shown at block 1128, an opening may be formed by detaching one side of the hang space 1100 from an adjacent side. The adjacent sides may be detached by disengaging a connection, such as a zippered connection, hook and loop fastener, button connection, etc. The opening provides access to an interior space of the hang space 1100. In this example, the hang space 1100 is used as a changing room.

Figure 12:
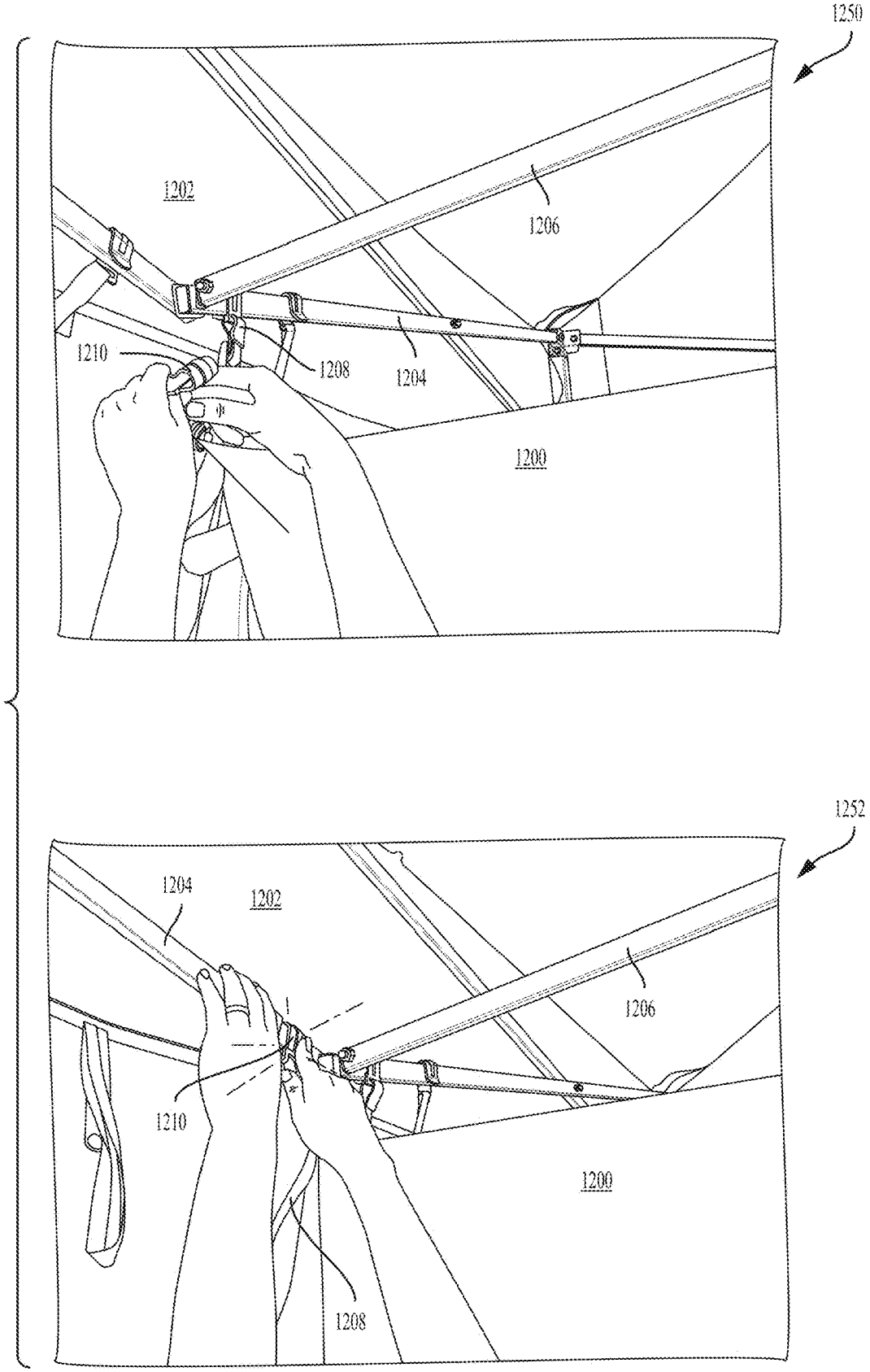

FIG. 12 illustrates an example of attaching a hang space 1200 to a shelter 1202 according to aspects of the present disclosure. As shown in FIG. 12, at block 1250, a first corner of the hang space 1200 is attached to an outer truss link 1204 of the shelter 1202 via a fastener 1210 attached to a strap 1208. The outer truss links 1204 form an upper perimeter of the shelter 1202. Each corner of the hang space 1200 includes a strap 1208 with a fastener 1210. The fastener 1210 may be attached to an outer truss link 1204, an inner truss link 1206, corner brace, center brace, joint, leg, or another structure of the shelter 1202. Additionally, at block 1252, a second corner of the hang space 1200 is attached to an outer truss link 1204 of the shelter 1202 via a fastener 1210 attached to a strap 1208.

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A hanging room, comprising:

three sides;

a plurality of upper fastening straps, a first fastening strap of the plurality of upper fastening straps attached to a first upper junction of a first side and a second side of the at least three sides, a second fastening strap of the plurality of upper fastening straps attached to a second upper junction of the second side and a third side of the at least three sides, and a third fastening strap of the plurality of upper fastening straps attached to a third upper junction of the third side and the first side; and a plurality of upper fasteners, each upper fastener attached to one of the plurality of upper fastening straps, a first fastener of the plurality of upper fasteners attaches the hanging room to an inner truss link of a shelter, and a second fastener of the plurality of upper fasteners attaches the hanging room to an outer truss link of a shelter.

2. The hanging room of claim 1, in which at least one side is detachably connected to an adjacent side.

3. The hanging room of claim 2, further comprising a connecting apparatus to detachably connect the at least one side to the adjacent side.

4. The hanging room of claim 3, in which the connecting apparatus is at least one of a zipper, hooks and loops, buttons, or a combination thereof.

5. The hanging room of claim 1, in which a third fastener of the plurality of upper fasteners attaches to one of an inner truss link, an outer truss link, a joint, a center bracket, a leg bracket, or a leg.

6. The hanging room of claim 1, further comprising a plurality of floor fastening straps attached to a lower portion of each side.

7. The hanging room of claim 6, further comprising a plurality of second fasteners, each second fastener attached to one of the floor fastening straps.

8. The handing room of claim 6, in which a first fastening strap of the plurality of floor fastening straps is attached to a first lower junction of the first side and the second side, a second fastening strap of the plurality of floor fastening straps is attached to a second lower junction of the second side and the third side, and a third fastening strap of the plurality of floor fastening straps is attached to a third lower junction of the third side and the first side.

* * * * *